United States Patent [19]

Persson et al.

[11] Patent Number: 4,858,532

[45] Date of Patent: Aug. 22, 1989

[54] SUBMUNITIONS

[75] Inventors: Per-Olof Persson; Kjell Albrektsson, both of Karlskoga; Jan Axinger, Storfors; Jan-Olof Fixell, Karlskoga, all of Sweden; Jari Hyvärinen, Stavanger, Norway

[73] Assignee: Aktiebolaget Bofors, Bofors, Sweden

[21] Appl. No.: 28,949

[22] Filed: Mar. 23, 1987

[30] Foreign Application Priority Data

Mar. 27, 1986 [SE] Sweden ..... 8601423

[51] Int. Cl.[4] ..... F42B 1/02; F42B 13/00

[52] U.S. Cl. ..... 102/387; 102/211; 102/214; 102/476

[58] Field of Search ..... 102/386-388, 102/393, 306, 307, 309, 211-214, 475, 476

[56] References Cited

U.S. PATENT DOCUMENTS

| | | | |
|---|---|---|---|
| 4,050,381 | 9/1977 | Heinemann | 102/387 |
| 4,176,814 | 12/1979 | Albrektsson et al. | 244/3.15 |
| 4,207,841 | 6/1980 | Bloomer | 102/214 |
| 4,492,166 | 1/1985 | Purcell | 102/393 X |
| 4,538,519 | 9/1985 | Witt et al. | 102/387 |
| 4,565,341 | 1/1986 | Zacharin | 102/386 X |
| 4,583,461 | 4/1986 | Weber | 102/393 |
| 4,583,703 | 4/1986 | Kline | 102/388 X |
| 4,622,900 | 11/1986 | Witt et al. | 102/387 |
| 4,635,553 | 1/1987 | Kane | 102/388 X |
| 4,655,411 | 4/1987 | Franzen et al. | 244/3.11 |
| 4,691,636 | 9/1987 | Witt et al. | 102/387 |

FOREIGN PATENT DOCUMENTS

| | | |
|---|---|---|
| 0137910 | 6/1983 | European Pat. Off. . |
| 86/00980 | 7/1984 | PCT Int'l Appl. . |

*Primary Examiner*—Daivd H. Brown

*Attorney, Agent, or Firm*—Pollock, Vande Sande & Priddy

[57] ABSTRACT

The disclosure relates to a submunition disposed to be separated from an aeronautical body, for example a shell carrier canister or the like above a target area, the submunition essentially including a warhead (5), a target detector (6) and a device which imparts rotation to the submunition for scanning the target area in a helical pattern (4) during the fall of the submunition towards the target area. The target detector (6) is pivotally disposed on a carrying shaft (12*a*) parallel to the line of symmetry (5*a*) of the warhead in order to permit outward activation of the target detector (6) from a collapsed position where the optical axis of the target detector coincides with the line of symmetry (5*a*) of the warhead to an activated position where the optical axis of the target detector is parallel with the line of symmetry (5*a*) of the warhead, so as to permit free scanning vision for the target detector (6) beyond the warhead (5).

5 Claims, 5 Drawing Sheets

SUBMUNITIONS

TECHNICAL FIELD

The present invention relates to a submunition which is arranged to be separated from an aeronautical body, for example a shell canister or the like, above a target area, the submunition comprising a warhead, a target detector and a device imparting rotation to the submunition for scanning the target area, in a helical pattern during the fall of the submunition towards the target area.

BACKGROUND ART

Despite improved methods for target ranging and fire control, conventional weaponry systems suffer from a limited effective range. The unavoidable spread of shot or projectile and difficulties in exactly ranging a target entail that hit probability declines rapidly as range increases. In such a situation, a considerable amount of ammunition and a generous amount of time are required to combat a target, factors which are not readily proffered in a combat situation.

For Forward Edge of Battle Area targets visible from the launching site, hit probability may be increased by the use of guided projectiles or missiles, for example a missile which is guided towards the target automatically or manually throughout its entire trajectory. However, such systems are apt to be extremely complex and, as a result, costly. Special launching devices are required for missiles and it must be possible for the gunnery officer to observe and track the target.

To improve hit probability and range of, for example, conventional anti-tank weapons, methods have recently been developed which are based on so-called final phase correction of the projectile. In such methods, the projectiles are discharged in a conventional manner in a ballistic trajectory towards the target. When the projectile approaches the proximity of the target, a target detector initiates the requisite trajectory correction in order that the target be hit.

The requirements for realizing final phase correction are two-fold: first, a target detector which emits a signal if the projectile is following a course towards a point beside the target; and secondly, means for correcting the trajectory of the projectile in response to the signal. The target detector may, for example, comprise a number of detector units, in which each detector is provided with an obliquely forwardly-trained field of vision such that, when the projectile approaches the target, the target scenario is scanned in an inwardly tapering helical pattern towards that point at which the projectile is currently aimed, the detectors being moreover in communication with, for example, correction motors in such a way that, if the projectile is following a trajectory to a point beside the target area (which may, for instance, be laser irradiated), ignition commands are transmitted to the correction motors such that the trajectory of the projectile is modified and the projectile is homed in on the target.

A final phase corrected, rotary projectile of this type with a correction motor comprising a number of individually selectable nozzles disposed about the periphery of the projectile and each connected to its detector is previously known from Swedish patent application No. 76.03926-2, corresponding to U.S. Pat. No. 4,116,814.

While such a homing phase-corrected projectile is both less complex to use and cheaper to manufacture than the missile which is guided onto the target automatically or manually throughout its entire trajectory, it is nevertheless necessary that the projectile or the shell be provided with complex components such as target detection device and correction motor. Furthermore, a laser transmitter is required for discharging a laser beam aimed at the target. The echo signal emitted by the laser irradiated target must be received by the target detection device and a signal must be given in response to the position of this echo signal for correcting the trajectory of the projectile.

It is previously known from Swedish patent application No. 83.01651-9 corresponding to U.S. Pat. No. 4,665,411 to reduce the spread of shot in a kill pattern for a shell by calculating, on the basis of its muzzle velocity, the point of impact of the shell and by transmitting to the shell a retardation command.

A conventional launching device, for example an artillery piece, may be employed and the shell may be provided with a conventional propellant charge. The fire command equipment must be fitted with muzzle velocity ($v_o$) measurement equipment and the shell with a receiver for receiving retardation commands from the launching site. In the example disclosed in the above-indicated Swedish patent application, the command is transmitted to the shell in question by the intermediary of a radio link.

Even though both the receiver and braking devices in the shell may be comparatively simple, the apparatus as a whole will nevertheless be rendered relatively complex because of the ground $v_o$ measurement equipment, radar unit and radio link equipment required. Furthermore, the risk of disturbances to the system is manifest, primarily in the form of intentional jamming from the enemy.

For both missiles and the guided shells mentioned above, it is necessary that each discharged ammunition unit give a single point of impact within the target area. For a larger target area with a plurality of discrete targets, a large number of discharged shells will then be required for effectively countering and combating the target regions. As a result, it is also previously known to employ so-called submunition units which are discharged in a conventional manner in a ballistic trajectory towards the target area. After the shell canister has reached the target area, a number of submunition units are released. The submunition units are provided with target detector devices and, by imparting to the target detector device a wobbling, precession or helical motion, these can overfly the ground area under detection. On detection of a target, a projectile-forming hollow charge is initiated which has a penetration of large explosive force. The number of submunition units which may be accommodated in the canister depends upon the caliber and extraneous design of the system, for example the retardation and rotation devices of the submunition.

The target detection device may be of the IR type, but other types of target detectors may be employed, for example target detectors based on millimeter waves, or be of the magnetic or optic type. Combinations of target detectors are also conceivable. The target detector senses the target area and the detector signal is analyzed so as to distinguish between a target, for example an armored vehicle, and its background. When the target detector has revealed the target, the warhead is initiated.

Prior art brake rotation devices for realizing the sensing motion are often of the parachute type, but other devices employing mechanical vanes are also previously known. Thus, the submunition may be provided with an asymmetric parachute which imparts the desired rotation for the scanning operation, or alternatively the submunition may be of such aerodynamic design as to realize the requisite rotation. The drawback inherent in employing parachutes is that a relatively large space is then required in the shell canister, which reduces the number of submunition units in the canister.

As examples of prior art submunition systems, mention might be made of the American Sense and Destroy Armor system employing a 15.5 cm caliber shell canister developed by Avco Systems Division, USA. The Sense and Destroy Armor canister contains four discrete submunition units which are ejected from the base plane of the canister when the canister has reached the target area. As a result of the natural rotation of the submunitions on separation and by the provision of a so-called "maple seed wing" a helical scanning of the target area will be obtained.

The skilled reader of this specification is further referred to GB-PS 2 090 950 and DE-PS 3 323 685. This latter patent specification discloses a system in which the fall speed and direction of movement of the submunitions are regulated by an asymmetric parachute and in which the rotation requisite for the scanning operation is realized by a drive thrust motor.

Drawbacks common to the prior art systems are their high degree of complexity and the difficulty in imparting to the submunition a controlled fall speed and rotation.

OBJECT OF THE PRESENT INVENTION

The object of the present invention is to realize a submunition, preferably for combating medium and heavily armoured targets by indirect fire, the submunition having been given such aerodynamic design that rotation is obtained and fall speed is governed, the submunition according to the present invention requiring less space in the carrier canister so that an increased number of submunition units may be accommodated per canister.

The nature of the present invention and its aspects will be more readily understood from the following brief description of the accompanying Drawings, and discussion relating thereto.

DESCRIPTION OF PREFERRED EMBODIMENT

Figure 1:
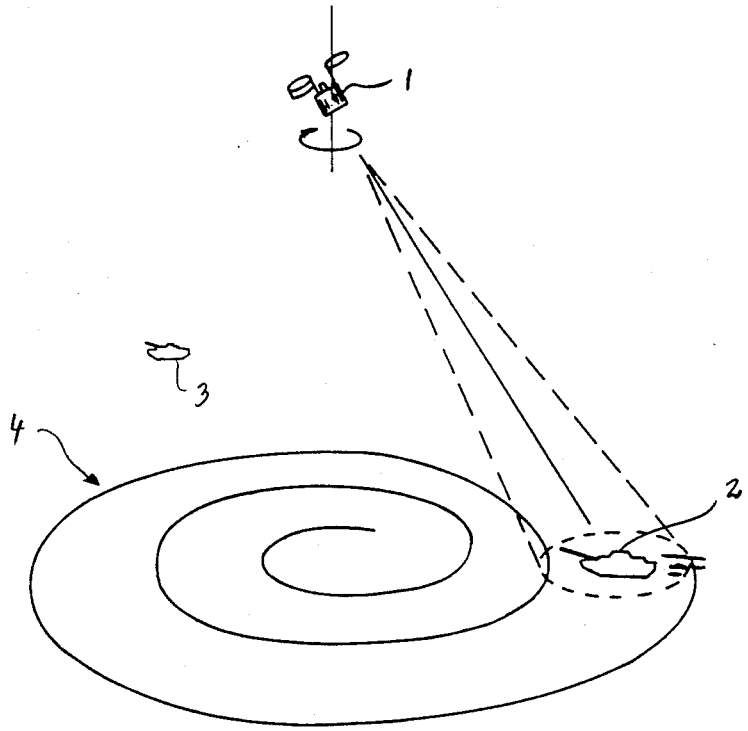
FIG. 1 is a schematic outline of the scanning movement of the submunition.

Referring to the drawings, FIG. 1 illustrates a submunition 1 which has been separated from a canister in a carrier shell. The carrier shell, the canister and the separation procedure are not considered here in greater detail since they do not form a part of the present invention. By way of example, the carrier shell may be a 15.5 cm caliber discharged from a field artillery piece in a conventional manner in a ballistic trajectory towards a target area with discrete targets in the form of armored vehicles 2 and 3.

The submunition comprises a target detector and a warhead in the form of a projectile-forming hollow charge. The optic axis of the target detector is parallel to the axis of symmetry of the warhead. In order to increase the scanned target area, the submunition is disposed so as to execute a rotary movement about an axis which is tilted at an angle of approx. 30° to the optical axis of the target detector. The manner in which this rotation is achieved will be described in greater detail below. When the submunition has attained its stable state, its axis of rotation will coincide with the vertical axis. As the submunition falls, it will scan the area beneath it following a helical pattern 4. When the target detector reveals a target, the warhead is initiated.

As has been mentioned by way of introduction, it is previously known to provide submunitions with parachutes in order to decelerate their fall towards the ground. One of the drawbacks inherent in employing parachutes is the space requirement involved. With this in mind, the submunition according to the present invention has been made of such aerodynamic design as to impart spin, and fall speed will be thus restricted without the need of a parachute. the aerodynamic design of the submunition must be such as to provide the four following properties:

- a stable, spinning movement about a desired, optional axis through the point of gravity of the submunition,
- a controlled angular speed about a selected axis,
- a controlled fall speed, and
- a controlled direction to counter the effects of side winds.

According to the laws of physics, a free, non-symmetrical, three-dimensional body having three different moments of inertia about its principle axis will rotate stably about that axis which has the least moment of inertia and that which has the greatest, respectively. By distributing the mass of the body in order to attain concordance with the above principles, the body may be caused to rotate stably about a predetermined and optionally selected axis.

If the body is exposed to an impinging medium, for example air, it will be subjected to external forces. In free fall in the air, these forces have a decelerating effect on the translation speed. This deceleration effect can be controlled by a suitable design of the area exposed to impingement, or by modification of the total mass. If such impingement gives a component of forces which is transverse to the direction of impingement and which does not pass through the contemplated axis of rotation, a driving force moment will arise about the shaft. This causes the body to spin. By suitable design of the body, this driving moment of forces—and thereby the spinning speed—may be controlled. In order to obtain the desired orientation (up or down) of the axis of spin in relation to the direction of impingement, the center of pressure must, according to prior art technique, be disposed aft of the center of gravity.

To possess the four properties as set forth above, the body must be designed according to the following rules:

Design of the body must be such that the smallest or largest major axis of the body coincide with the desired spinning axis, The design of the body must be such that suitable driving moment of force occurs about the spinning axis, Design of the body must be such, in free fall, that the effective decelerating area be in correct proportion to the mass of the body, and Design of the body must be such that the center of pressure is located to the rear of the point of gravity, seen from the direction of impingement.

Figure 2:
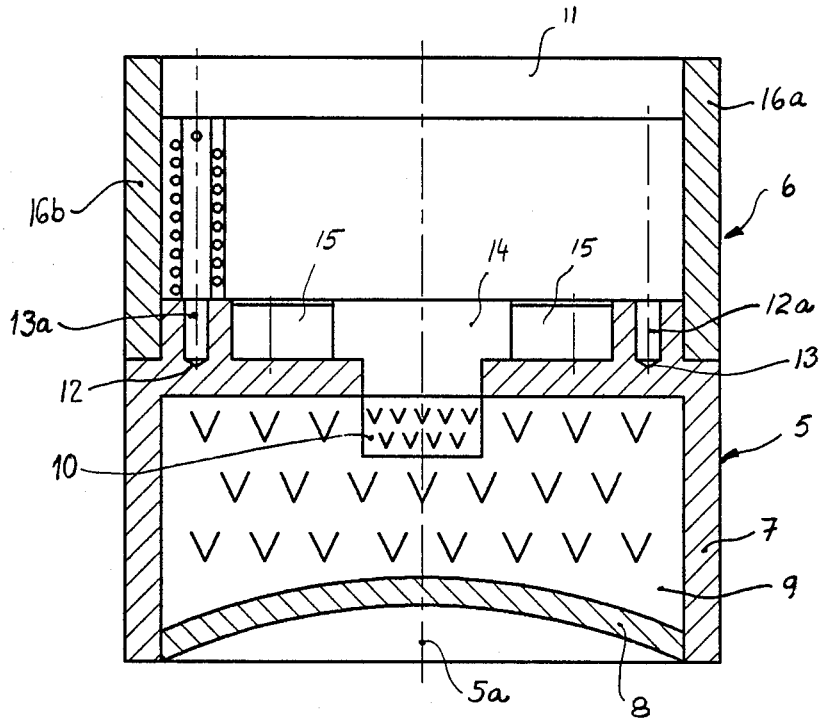
FIG. 2 illustrates the submunition in the safe, unactivated state.

FIG. 2 illustrates in greater detail the construction of the submunition. In this figure, the submunition is illustrated in its safe, unactuated state as assumed when the submunition is disposed within the canister. As soon as the submunition has been separated from the canister it will assume its activated state—being such that the desirable aeromechanical properties as set out in the theoretical conditions disclosed above will be satisfied.

As will be apparent from FIG. 2, the submunition is constructed as a compact cylindrical body whose length has been reduced to a minimum in order to make room for as large a number of discrete submunitions as possible within the carrier canister. The submunition consists of two major parts, a warhead 5 and a target detector 6. The warhead 5 constitutes the base section of the submunition, while the target detector 6 is disposed in its upper section.

The warhead 5 consists of a projectile-forming hollow charge of the self-forging fragment type or explosively formed penetrator type which comprises a steel casing 7 and a metal inlay 8 surrounding a chamber 9 for an explosive charge of, for example, octol. The charge further includes a detonator 10 for bursting of the charge. The theory relating to such directed explosive charges is previously known, see, for example, Arvidsson, Bakowsky, Brown, "Computational Modeling of Explosively Formed Hypervelocity Penetrators", International Conference on High Energy Rate Fabrication Methods, San Antonio, Tex., U.S.A., June, 1984.

The steel casing 7 includes a cylindrical portion which also constitutes the outer casing of the submunition, and a bottom portion in whose center the detonator 10 is disposed. The bottom portion of the steel casing further includes two diametrically disposed mountings 12 and 13 for the detector 6 and for a support surface 11 (whose function will be more closely described with reference to FIG. 3) substantially in the form of a circular disk forming a top cover for the upper section of the submunition.

Both the target detector 6 and the carrier surface 11 are pivotally disposed each on their activation axes 12*a*, 13*a*, these axes being parallel to the line of symmetry 5*a* of the warhead.

The submunition further includes a Safing, Arming and Ignition (SAI) unit 14. The SAI unit is activated by the linear acceleration and rotation of the discharge environment. The linear acceleration also activates the batteries 15 of the submunition for power supply.

The upper section of the submunition, i.e. fundamentally the detector 6, is encased by two loose semi-cylindrical steel members 16*a*, 16*b*. When the submunition is disposed within the canister, the steel half cylinders are intended to absorb the linear acceleration to which the submunition is subjected on discharge. As soon as the submunition has been separated from the canister, the steel semi-cylinders are shedded from the submunition and thereby permit activation of the detector 6 and the carrier surface 11.

Figure 3:
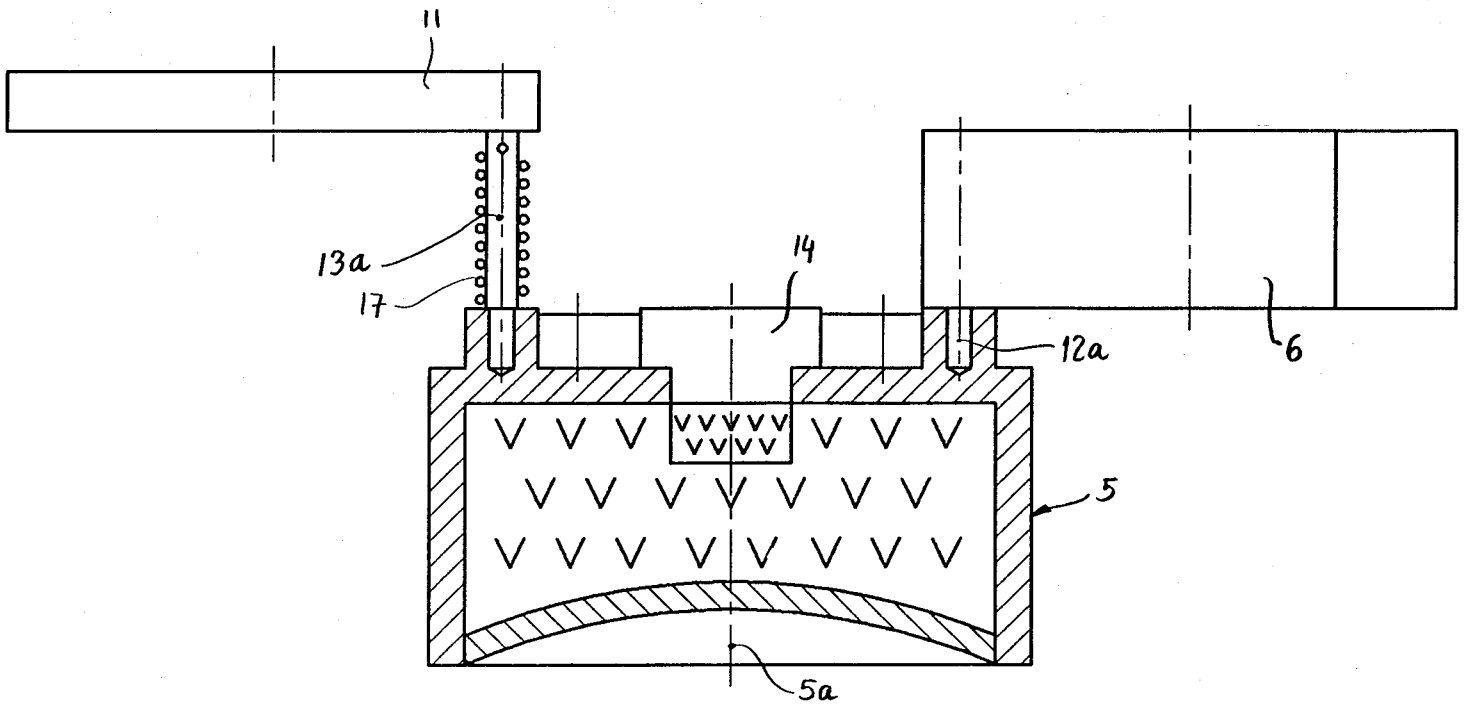
FIG. 3 shows the submunition in the activated state, after separation from the canister.
Figure 4:
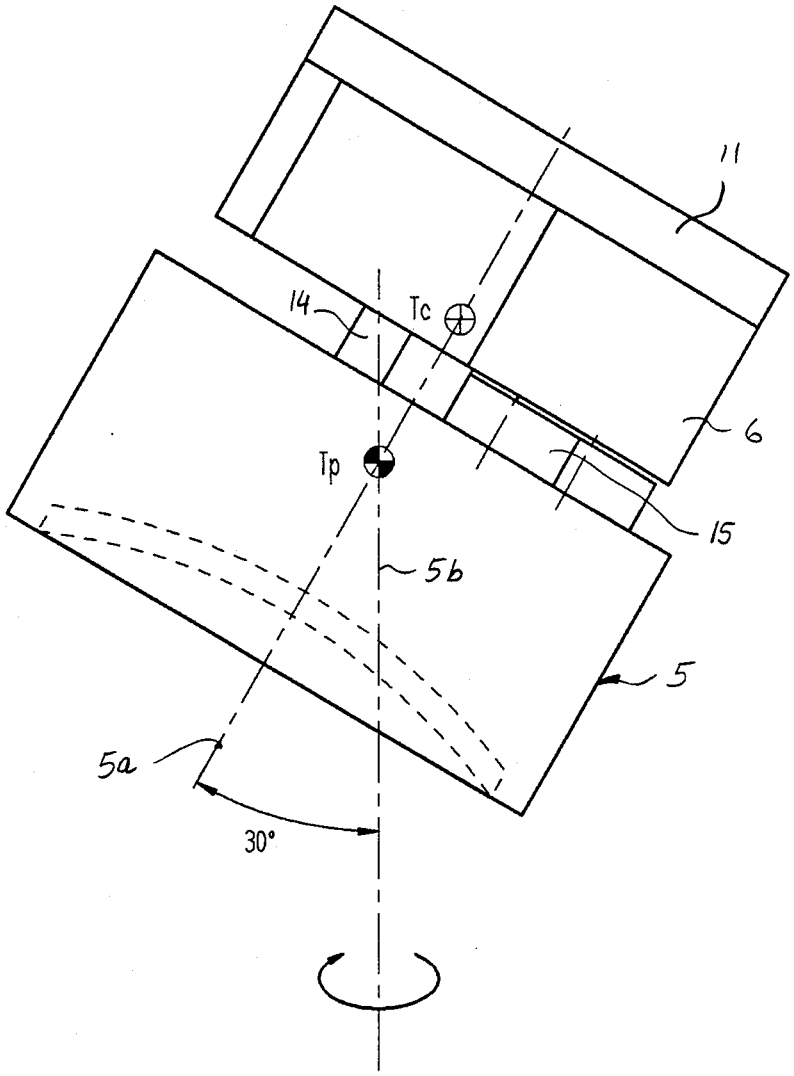
FIG. 4 is a side elevation of the submunition.

In order to impart to the three-dimensional body, the submunition, a controlled scanning motion of the target area, for example a controlled rotation and fall speed, the detector 6 and the carrier surface 11 are, as has been mentioned above, pivotally disposed each on their activation axes 12*a* and 13*a*, respectively. In FIG. 3, the submunition is illustrated in its activated state, for example in that state which the submunition assumes on being separated from the canister. Both the detector 6 and the carrier surface 11 are pivoted 180° through their respective mounting axes, appropriately with the assistance of torsion springs, one of these torsion springs 17, for the carrier surface 11, being shown on the Figure. The thus formed body is dimensioned so as to obtain desirable aeromechanical properties according to the theory described above. Thus, the submunition executes a spinning movement about its spinning axis (5*b*) (axis of rotation) through the point of gravity $T_p$ of the submunition, see FIG. 4. A driving moment of force arises about the spinning axis, thus imparting a spin to the submunition proper. Both the detector and the carrier surface 11 impart a decelerating effect on the speed of fall. The effective decelerating area must be in correct proportion to the mass of the submunition in order to realize a suitable falling speed for the submunition. Furthermore, the design of the submunition is such that its the center of pressure $T_c$ is located to the rear of the point of gravity $T_p$ on the axis of symmetry (5*a*) of the submunition as seen from the air impingement direction.

The optical axis of the detector which is parallel to the axis of symmetry, makes an angle "owl angle" of approx. 30° with the axis of spin, with the result that the detector scans the target area in a helical pattern. The axis of spin is determined by the axis of major inertia which, in its turn, is determined by the mass distribution of the submunition, in particular the placement of the batteries 15.

Figure 5:
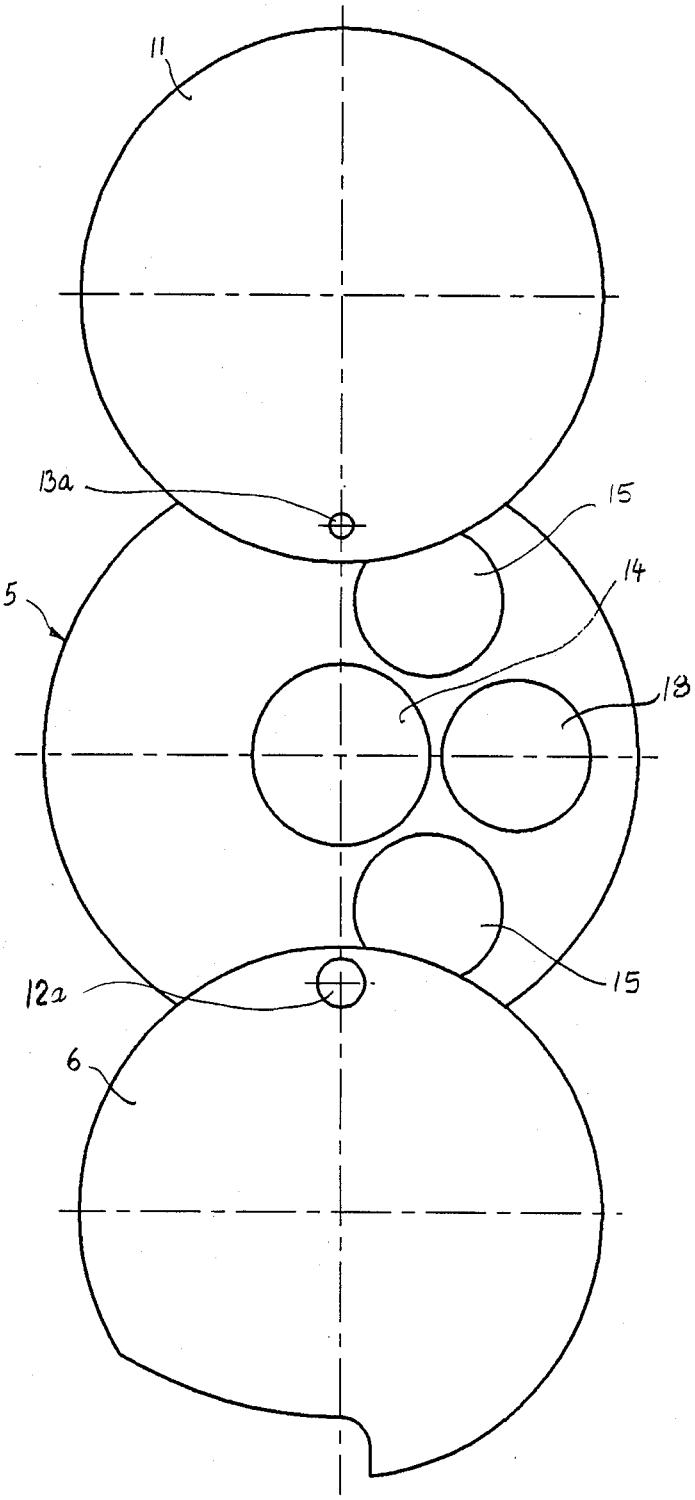
FIG. 5 is a top plan view of the submunition.

FIG. 5 is an oblique top plan view of the submunition. The design and the construction of the target detector will not be discussed in detail here. Nonetheless, this may advantageously be of the IR type and should have sufficient field of view and aperture to provide sufficient required range. Other types of detectors may, however, also be employed, such as target detecting devices based on millimeter waves. A common requirement of all target detectors is that they must be actuable in the manner described above and, together with the extra carrier surface 11, impart to the submunition a desired speed of fall and rotation.

When combined target detectors are employed—for example operating on the IR and millimeter wave principles, the extra carrier surface 11 may advantageously accommodate the supplementary target detector.

FIG. 5 also illustrates the location of the batteries 15, here in combination with an extra weight 18 in order to provide the desired mass distribution.

The invention should not be considered as restricted to the embodiment described above, and shown on the drawings, many modifications being conceivable without departing from the spirit and scope of the appended claims.

What we claim and desire to secure by Letters Patent is:

1. A submunition arranged to be separated from an aeronautical body over a target area, the submunition comprising:

a warhead, a target detector being pivotally mounted on a mounting shaft disposed on said warhead parallel with an axis of symmetry of the warhead to activate said target detector outwardly between a retracted position in which an optical axis of the target detector coincides with the axis of symmetry of the warhead to an extended position in which the axis of symmetry of the warhead permits free vision of the target detector beyond the warhead; and a carrier surface member for imparting a controlled rotation and fall speed to the submunition for scanning of the target area in a helical pattern during the fall of the submunition towards the target area, said carrier surface member being pivotally mounted on said warhead between a retracted position and an outwardly extended position, said carrier surface member in said retracted position having its axis of symmetry aligned with the axis of symmetry of said warhead and in said outwardly extended position extends beyond the warhead.

2. A submunition as claimed in claim 1, wherein said carrier surface member is pivotally disposed on a mounting shaft parallel to the axis of symmetry of the warhead in order to permit activation of the carrier member outwardly from said retracted position to said extended position beyond the warhead, said mounting shafts of said target detector and said carrier surface member respectively, are located on the submunition in diametrically opposed relationship.

3. A submunition as claimed in claim 2, wherein both the target detector and the carrier surface member are rotated 180° about their respective mounting shafts upon activation to their extended positions.

4. A submunition as claimed in claim 3, wherein the target detector includes large and small major axes one of which coincides with the axis of spin, the mass of the submunition is preselected with respect to effective decelerating area of said detector and said carrier surface member to allow a predetermined speed of fall, a driving moment of force occurs about the axis of spin, and the center of pressure ($T_c$) is located behind the point of gravity ($T_p$) seen from the direction of impingement.

5. A submunition as claimed in claim 4, further comprising a supplementary target detector disposed on said carrier surface member.

* * * * *